US008074302B1

(12) United States Patent
Kook

(10) Patent No.: US 8,074,302 B1
(45) Date of Patent: Dec. 13, 2011

(54) TOILET SEAT QUICK RELEASE SYSTEM

(75) Inventor: Richard Kook, East Hanover, NJ (US)

(73) Assignee: Foremost Groups, Inc., East Hanover, NJ (US)

( * ) Notice: Subject to any disclaimer, the term of this patent is extended or adjusted under 35 U.S.C. 154(b) by 0 days.

(21) Appl. No.: 12/977,290

(22) Filed: Dec. 23, 2010

Related U.S. Application Data

(60) Provisional application No. 61/397,210, filed on Jun. 7, 2010.

(51) Int. Cl.
*A47K 13/12* (2006.01)
*A47K 13/00* (2006.01)

(52) U.S. Cl. ..... 4/236; 4/235; 4/239; 4/240; 16/365

(58) Field of Classification Search ..... 4/234, 236, 4/239, 240, 235, 237, 238, 241; 16/365, 16/261, 264
See application file for complete search history.

(56) References Cited

U.S. PATENT DOCUMENTS 5,457,824 A * 10/1995 Reed ..... 4/234
6,070,295 A 6/2000 Hulsebus
6,101,640 A * 8/2000 Brewer et al. ..... 4/236
7,203,975 B2 * 4/2007 Vierkant, III ..... 4/240

* cited by examiner

*Primary Examiner* — Gregory Huson
*Assistant Examiner* — Erin Deery
(74) *Attorney, Agent, or Firm* — Law Offices of S.J. Christine Yang; Victoria Hao

(57) ABSTRACT

A toilet seat and lid quick release hinge system utilizing a toilet seat and lid hinge hold-down screw with a release lever at the bottom. The hold-down screw has a head flange with diametrically opposed, outwardly extending projections. These projections engage a slot in the hinge mount of a toilet seat and lid hinge assembly, thereby releaseably holding the seat and lid hinge assembly to the toilet bowl.

11 Claims, 6 Drawing Sheets

TOILET SEAT QUICK RELEASE SYSTEM

The present invention claims priority to provisional application no. 61/397,210 filed on Jun. 7, 2010 which is incorporated in its entirety by reference.

BACKGROUND OF THE INVENTION

1. Field of the Invention

The present invention relates to a toilet seat and lid quick release hinge system. Although embodiments of the invention is suitable for a wide scope of applications, it is particularly suitable for enabling quick release of a toilet seat from a toilet bowl, for releasing a toilet seat without undoing mounting screw or bolts from the toilet bowl and for putting down the lid when the seat is put down from a raised position.

2. Discussion of the Related Art

A toilet seat generally requires more frequent replacement than a toilet bowl due to wear and tear, and a toilet seat can be replaced without replacing the entire toilet. A toilet seat also can be replaced to match any bathroom color scheme or motif.

In general, a toilet seat is affixed to a toilet bowl by placing mounting screws or bolts through a flange portion of the toilet bowl and by fastening screw nuts from the bottom surface of the toilet bowl to the mounting screws. Conventionally, to replace the toilet seat, each of the screws or mounting bolts needs to be unfastened from the washers and nuts. However, as mounting screws and bolts rust or corrode especially in a moist environment, the screws or the mounting bolts can be hard to loosen or unfasten. Furthermore, the nuts can recess due to the passage of time, making the nuts practically inaccessible and toilet seat replacement difficult.

U.S. Pat. No. 6,070,295 to Hulsebus discloses a "Quick Release Seat Hinge With Swivel" formed of a "mounting post" fixed to the toilet bowl, a "hinge post" connected to the toilet seat, and a "latch member" that engages the hinge and mounting posts. The latch member is moved to "a latched position" to "directly or indirectly" engage the mounting post and hold the toilet down. The latch member is also "movable to an unlatched position wherein the latch member is directly or indirectly disengaged from the mounting post" to allow the seat to be lifted up from the mounting post. The latch member also has a "top wall" and, when the latch member is in the latched position, the top wall "substantially completely covers the mounting post". The hinge post and latch member form two, moving parts that must engage each other. Dirt and filth can enter the joints between these parts, which forms a breeding ground for bacteria. Moreover, the moving parts can become separated and lost or broken. What is needed is a toilet seat and lid quick release assembly with a hinge mount formed as a single piece and a quick release lever that engages the hinge mount from beneath.

SUMMARY OF THE INVENTION

The present invention utilizes a toilet seat and lid hinge hold-down screw with a release lever at the bottom. The hold-down screw has a head flange with diametrically opposed, outwardly extending projections. These projections engage a slot in the hinge mount of a toilet seat and lid hinge assembly, thereby releaseably holding the seat and lid hinge assembly to the toilet bowl. When the user wants to remove the seat and lid, in order to clean the toilet bowl or seat, for example, the release levers can be turned to free the projections from the hinge assembly.

Accordingly, embodiments of the invention are directed to a toilet seat and lid hinge assembly that substantially obviates one or more of the problems due to limitations and disadvantages of the related art.

An object of embodiments of the invention is to provide a hinge assembly that provides easy installation and quick release of a toilet seat.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a device for affixing a toilet seat to a toilet bowl includes a mounting post having a mounting post bore therein a first screw for passing through the mounting post bore, the first screw having a head with at least one projection, a nut for fastening the mounting post onto the toilet bowl a lever for coupling to the first screw and for selectively rotating the first screw, and a hinge mount for coupling to the toilet seat, the hinge mount having an opening for receiving the head of the first screw and a locking slot for selectively receiving the projection of the first screw.

In another aspect, a hinge assembly includes a mounting post having a mounting post bore therein, a first screw for passing through the mounting post bore, the first screw having a head with at least one projection, a lever extender for coupling to the first screw and for selectively rotating the first screw, and a hinge mount having an opening for receiving the head of the first screw and a locking slot for selectively receiving the projection of the first screw It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Reference will now be made in detail to the preferred embodiments of the invention, examples of which are illustrated in the accompanying drawings.

Figure 1:
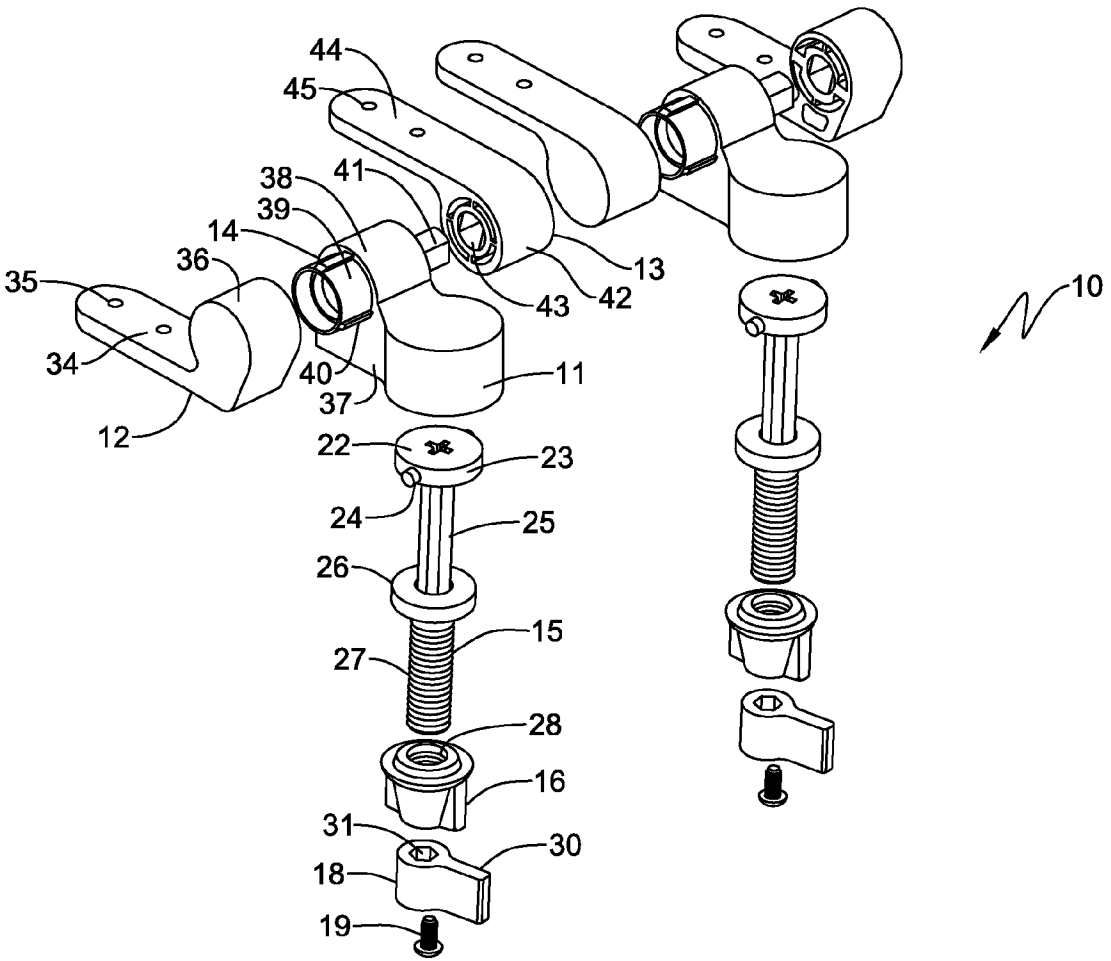
FIG. 1 is a perspective, exploded view of the parts according to an embodiment of the present invention.

FIG. 1 shows an exploded view of the parts of the toilet seat quick release system 10 according to an embodiment of the present invention. A hinge mount 11 is secured to the top of a toilet bowl (not shown). The hinge mount 11 has a forward-facing body portion 37 which forms a hinge structure 38. A hinge axle 14 extends through a bore 46 (shown in FIG. 3A) in the hinge structure 38. A first hinge 12 has a first hinge head 36 with a bore 50 (shown in FIG. 4) into which the first hinge axle journal 39 is inserted. The first hinge 12 can rotate on the journal 39. The first hinge 12 has a forward-facing tongue 34 with holes 35. The tongue 34 provides the first hinge surface to which a toilet seat 20 (shown in FIG. 2) or lid 21 (also shown in FIG. 2) can be fixed with screws (not shown). A second hinge 13 has a second hinge head 42 with a substantially rectangular bore 43 into which the substantially rectangular axle journal 41 is inserted. It will be appreciated that, owing to the rectangular bore 43 and journal 41, when the second hinge 13 is rotated with respect to the hinge structure 38 of the hinge mount 11, the axle 14 will rotate.

Figure 2:
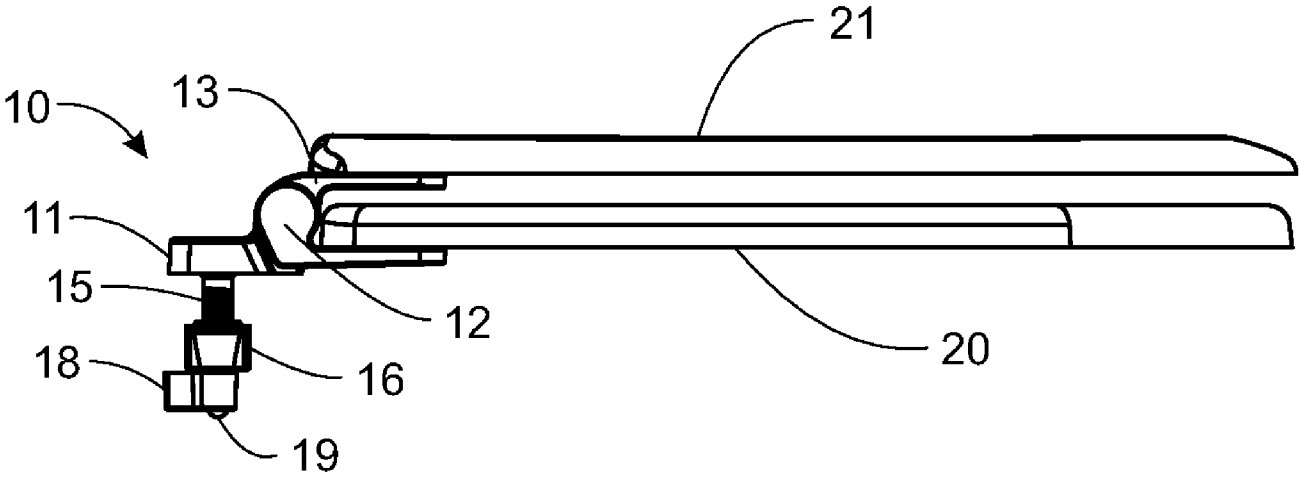
FIG. 2 is a side view of the toilet quick release system according to an embodiment of the present invention attached to a toilet seat and lid.

In a preferred embodiment, ribs 40 on the surface of the first axle journal 39 frictionally engage the bore 50 of the first hinge 12, so that when the axle 14 rotates it exerts rotating force to the first hinge 12. In this way, if the first hinge 12 is mounted to the toilet seat 20, as shown in FIG. 2, putting down the seat 20 from a raised position will also cause the lid 21 to follow. The second hinge 13 has a forward-facing tongue 44 with holes 45. The tongue 44 provides the second hinge surface to which a toilet lid 21 (shown in FIG. 2) or seat 20 (also shown in FIG. 2) can be fixed with screws (not shown).

Figure 5:
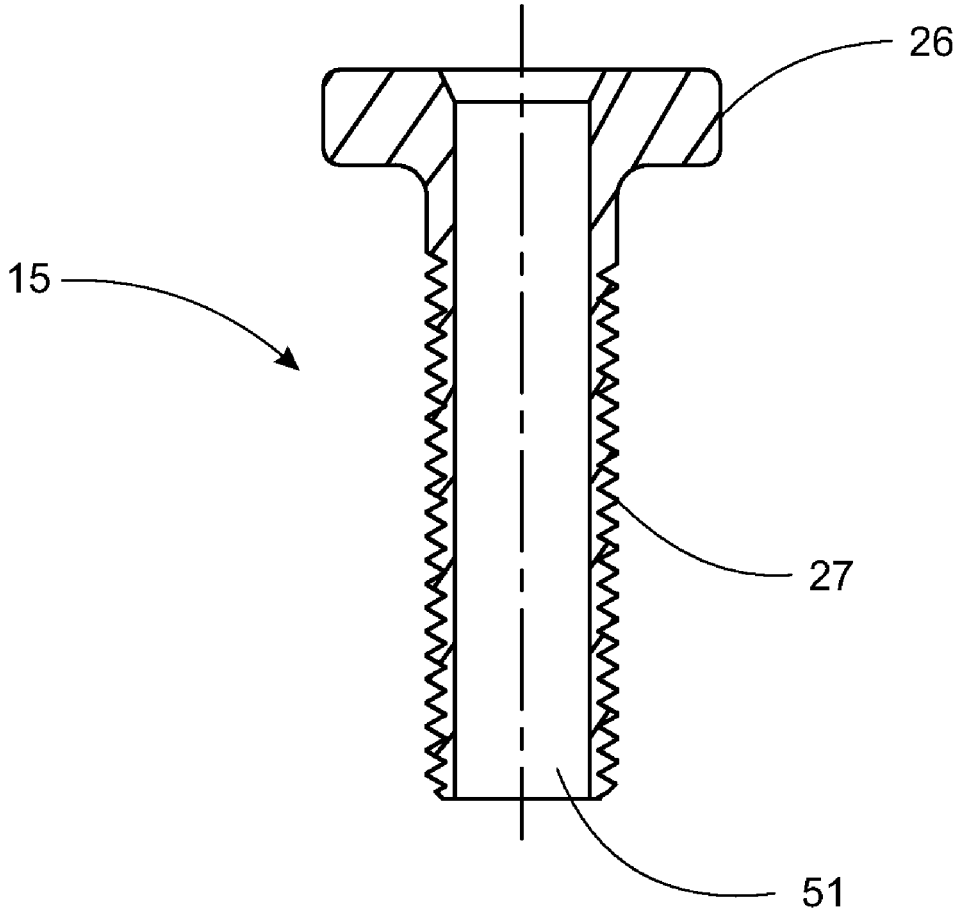
FIG. 5 is a side, cross-section view of a mounting post according to an embodiment of the present invention.
Figure 6A:
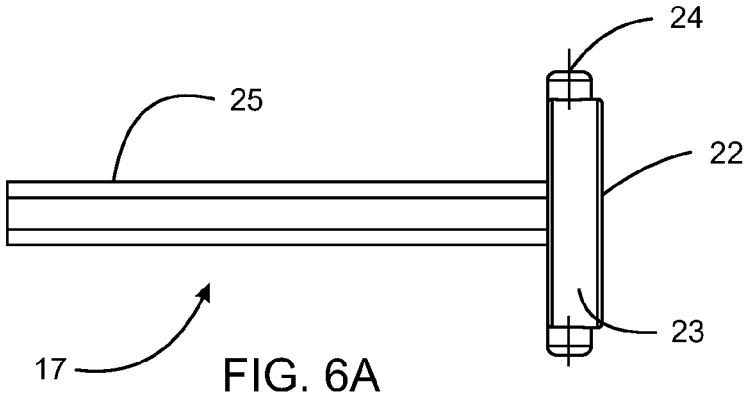
FIG. 6A is a side view of a hinge hold down screw according to an embodiment of the present invention.
Figure 6B:
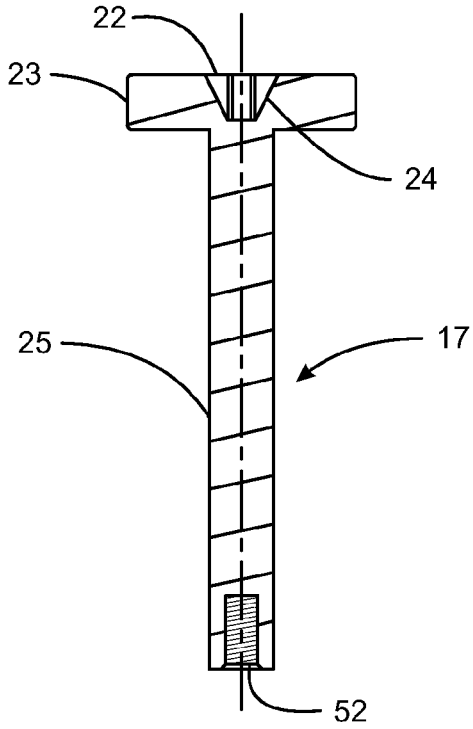
FIG. 6B is a side, cross-section view of a hinge hold down screw according to an embodiment of the present invention.
Figure 6C:
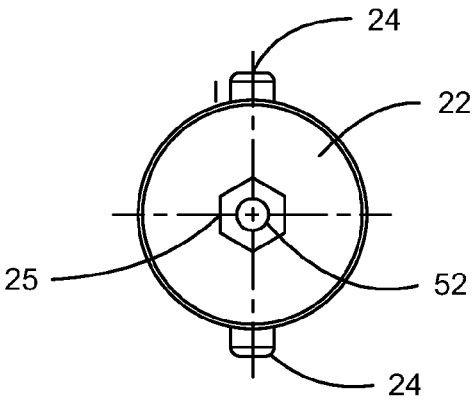
FIG. 6C is a bottom view of the hinge hold down screw according to an embodiment of the present invention.

The hinge mount 11 is secured to a toilet bowl by a quick release hinge hold-down screw 17 which extends through the bore 51 (shown in FIG. 5) extending through a mounting post 15. The mounting post 15 is sized to fit through the conventional holes (not shown) that extend down through the bottom surface of a toilet bowl. The mounting post 15 has a flanged head 26 that rests on top of the toilet bowl and a threaded shaft 27 that extends through the holes in a toilet bowl and extends below the bottom lip of the toilet bowl. A mounting post nut 16 has a threaded bore 28 that mates with the shaft 27 to secure the mounting post 15 to the toilet bowl. The hinge hold-down screw 17 has a hexagonal shaft 25 (shown in FIG. 6C) that is sized to rotate within the mounting post bore 51. The hinge hold-down screw has a flanged head 22 that rest on top of the head 26 of the mounting post 15. The hold-down screw 17 extends through the bottom of the mounting post 15 and a release lever 18 is fixed to the bottom of the hexagonal shaft 25 of the hold-down screw 17 by a screw 19 that threads into a threaded bore 52 (shown in FIG. 6B) at the bottom of the hexagonal shaft 25. A hexagonal bore 31 in the release lever 18 mates with the hexagonal shaft 25 of the hold-down screw 17. It will be appreciated that, owing to the hexagonal shape of the hold-down screw 17 shaft 25 and the complimentary bore 31 of the release lever 18, when the extension 30 of the release lever 18 is turned, it rotates the hold-down screw 17.

Figure 3A:
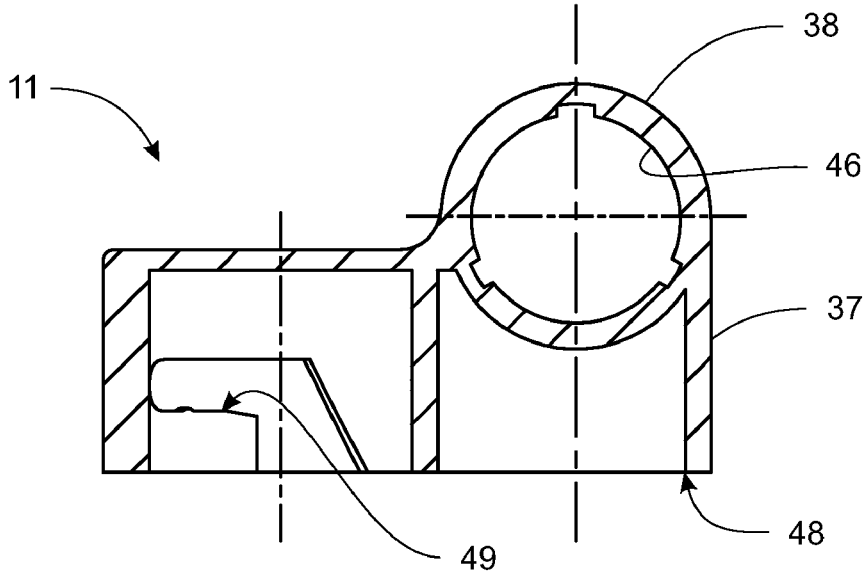
FIG. 3A is a side view of the hinge mount according to an embodiment of the present invention.
Figure 3B:
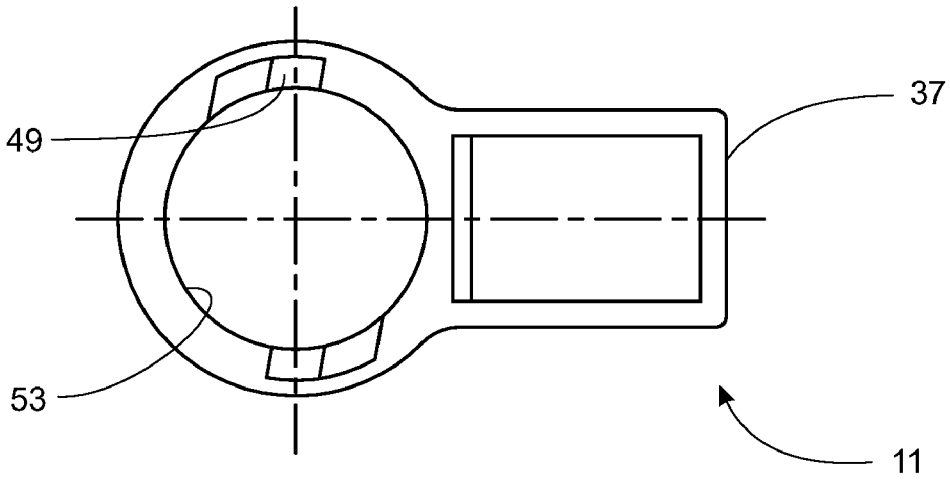
FIG. 3B is a bottom view of the hinge mount according to an embodiment of the present invention.
Figure 4:
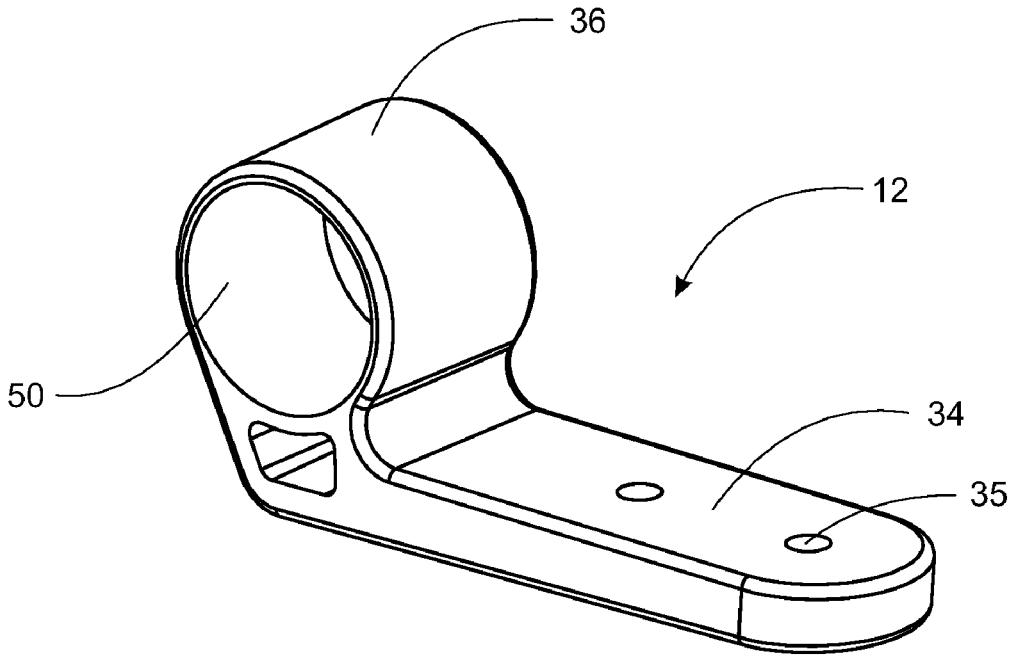
FIG. 4 is a perspective view of a first hinge part according to an embodiment of the present invention.

The peripheral edge 23 of the flanged head 22 of the hold-down screw 17 has a pair of diametrically-opposed projections 24. As shown in FIGS. 3A and 3B, the hold-down screw projections 24 engage a locking slot 49 in an opening 53 of the hinge mount 11. Thus, turning the release lever 18 in one direction forces the projections 24 of the hold-down screw 17 into the locking slot 49 and secure the hinge mount 11 to the toilet bowl.

The system described above allows a toilet seat and lid to be removed easily from a toilet bowl, which makes cleaning the toilet much easier. The release lever 18 is located below the mounting post 15 and its nut 16, below the back lip of a conventional toilet bowl. By turning the release lever 18 in one direction, the hold-down screw projections 24 are released from the locking slot 49 in the hinge mount 11 and the hinge mounts 11, along with the seat 20 and lid 21 can be lifted from the bowl. Placing the hinge mount 11 onto the flanged-head 22 of the hold-down screw 17 and turning the release levers 18 in the opposite direction secures the hinge mount 11 onto the bowl.

As a result, the hinge assembly according to an embodiment of the present invention easily installs a toilet seat and allows quick release of the toilet seat. In addition, the toilet seat can be replaced without loosening the mounting screw from a bottom surface of the toilet bowl. Thus, maintenance and repair of a toilet seat according to an embodiment of the present invention is improved.

The hinge assembly according to an embodiment of the present invention also enables quick release of a toilet seat. The toilet seat can be removed without unfastening or undoing mounting bolts and nuts that are attached to the toilet bowl.

It will be apparent to those skilled in the art that various modifications and variations can be made in the hinge assembly of embodiments of the invention without departing from the spirit or scope of the invention. Thus, it is intended that embodiments of the invention cover the modifications and variations of this invention provided they come within the scope of the appended claims and their equivalents.

The drawings and description set forth here represent only some embodiments of the invention. After considering these, skilled persons will understand that there are many ways to make toilet seat and lid quick release hinge systems according to the principles disclosed. The inventor contemplates that the use of the alternative structures, materials, or manufacturing techniques, which result in a toilet seat and lid quick release hinge system according to the principles disclosed, will be within the scope of the invention.

What is claimed:

1. A device for affixing a toilet seat to a toilet bowl, comprising:

a mounting post having a mounting post bore therein;

a first screw for passing through the mounting post bore, the first screw having a head with at least one projection; wherein the first screw includes a threaded bore therein for receiving a second screw, and wherein the second screw couples the lever to the first screw;

a nut for fastening the mounting post onto the toilet bowl;

a lever for coupling to the first screw and for selectively rotating the first screw; and a hinge mount for coupling to the toilet seat, the hinge mount having an opening for receiving the head of the first screw and a locking slot for selectively receiving the projection of the first screw.

2. The device according to claim 1, wherein when the lever is moved in a first direction into a first position and as the lever rotates the first screw within the mounting post bore, the projection of the first screw moves into the locking slot of the hinge mount and the mounting post engages with the hinge mount.

3. The device according to claim 2, wherein when the lever is moved in a second direction away from the first position and as the lever rotates the mounting post and the first screw, the projection of the first screw moves out of the locking slot of the hinge mount and the mounting post releases from the hinge mount.

4. The device according to claim 1, wherein the first screw further comprises another projection, the projections being diametrically opposed from one another.

5. The device according to claim 1, wherein the hinge mount includes a hinge axel for receiving a first hinge at a first end and a second hinge at a second end.

6. The device according to claim 5, wherein the first hinge couples to the toilet seat and the second hinge couples to the toilet seat cover.

7. The device according to claim 6, wherein when the toilet seat is moved from a raised position to a down position and as the hinge axel moves by the first hinge, the second hinge concurrently rotates to move the toilet seat cover from a raised position to a down position.

8. A hinge assembly, comprising:

a mounting post having a mounting post bore therein;

a first screw for passing through the mounting post bore, the first screw having a head with at least one projection; wherein the first screw includes a threaded bore therein for receiving a second screw, and wherein the second screw couples the level extender to the first screw;

a lever extender for coupling to the first screw and for selectively rotating the first screw; and a hinge mount having an opening for receiving the head of the first screw and a locking slot for selectively receiving the projection of the first screw.

9. The assembly according to claim 8, wherein the lever extender includes a lever tab, and wherein when the lever tab is moved in a first direction into a first position and as the lever rotates the first screw within the mounting post bore, the projection of the first screw moves into the locking slot of the hinge mount and the mounting post engages with the hinge mount.

10. The assembly according to claim 9, wherein when the lever tab is moved in a second direction away from the first position and as the lever rotates the mounting post and the first screw, the projection of the first screw moves out of the locking slot of the hinge mount and the mounting post releases from the hinge mount.

11. The assembly according to claim 8, wherein the first screw further comprises another projection, the projections being diametrically opposed from one another.

* * * * *